United States Patent [19]

Friese et al.

[11] Patent Number: 4,946,471

[45] Date of Patent: Aug. 7, 1990

[54] ADHESION PROMOTER FOR LEATHER FINISHING

[75] Inventors: Hans-Herbert Friese, Monheim; Gerhard Kaindl, Hilden; Ludwig Schieferstein, Ratingen, all of Fed. Rep. of Germany

[73] Assignee: Henkel Kommanditgesellschaft auf Aktien, Duesseldorf, Fed. Rep. of Germany

[21] Appl. No.: 350,055

[22] Filed: May 10, 1989

[30] Foreign Application Priority Data

May 11, 1988 [DE] Fed. Rep. of Germany ..... 3816103

[51] Int. Cl.[5] ..... C14C 5/00

[52] U.S. Cl. ..... 8/94.23; 8/94.33; 8/94.19 R

[58] Field of Search ..... 8/94.21, 94.23; 526/307

[56] References Cited

U.S. PATENT DOCUMENTS 4,813,968 3/1989 Kaussen et al. ..... 8/94.23

OTHER PUBLICATIONS

Das Leder 27, (1976) pp. 142–151.

Ullmanns Encyclopedia Chem., (1980) pp. 3–4.

*Primary Examiner*—Paul Lieberman

*Assistant Examiner*—John F. McNally

*Attorney, Agent, or Firm*—Ernest G. Szoke; Wayne C. Jaeschke; Norvell E. Wisdom, Jr.

[57] ABSTRACT

Copolymers of (A) monomers containing amino groups and corresponding to general formula (I)

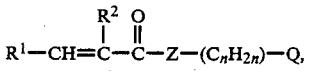

(I)

in which each of $R^1$ and $R^2$ independently represents a hydrogen or a methyl group; Z represents either an oxygen or a —NH— group; n is an integer from 2 to 5; $(C_nH_{2n})$ represents a bivalent saturated hydrocarbon moiety that may be straight chain or branched and that contains n carbon atoms; and Q is selected from the group consisting of piperazino, piperidino, and morpholino groups and groups having the formula $R^3$—N—$R^4$, with each of $R^3$ and $R^4$ independently representing a hydrogen or a $C_{1-4}$ alkyl group; and (B) monomeric esters corresponding to general formula (II)

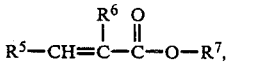

(II)

in which each of $R^5$ and $R^6$ independently represents a hydrogen or a methyl group and $R^7$ represents a $C_{1-6}$ alkyl group improve the adhesion of conventional leather finishes when used as separate adhesion promoters prior to conventional finishing or added to otherwise conventional primers or base coats.

20 Claims, No Drawings

ADHESION PROMOTER FOR LEATHER FINISHING

FIELD OF THE INVENTION

This invention relates to compositions and processes for improving the adhesion of the materials used as part of leather finishing.

STATEMENT OF RELATED ART

A leather finish is a protective layer which is applied to dried leather, after tanning and oiling it, to protect it against moisture, soiling, and damage. One of the requirements which an optimal finish has to satisfy is that it should adhere firmly to the leather. However, this particular requirement is not satisfactorily fulfilled by a number of finishing systems (see *Das Leder* 27, 142–151 (1976)). With water-resistant or hydrophobicized leathers, there is the added difficulty that any improvement in adhesion is often accompanied by a deterioration in the hydrophobic properties.

Applying an adhesion promoter composition is usually the first step in leather finishing; its primary purpose is to increase the adhesion to the leather of subsequently applied finishing materials that provide the bulk of the protection of leather against deterioration from exposure to various potential hazards. Accordingly, an object of the present invention is to improve adhesion promoter compositions for leather finishes.

DESCRIPTION OF THE INVENTION

Throughout this description, except in the operating examples or where explicitly indicated to the contrary, all numbers describing amounts of materials or conditions of reaction or use are to be understood as modified by the term "about".

It has now surprisingly been found that polyacrylates containing amino groups, which polyacrylates can be prepared by copolymerization of monomers containing amino groups and monomeric unsaturated esters, form a very good adhesion promoter on leathers, particularly hydrophobicized leathers, for the subsequent finishing processes. It has also surprisingly been found that, in the case of hydrophobicized leathers, the improvement in the adhesion of finishes is not accompanied by a deterioration in the hydrophobic properties.

Accordingly, a major embodiment of the present invention is a process for improving leather finishes, in which the leather is treated after tanning and oiling, but before application of the compositions that provide the bulk of the final finishing materials, with a composition comprising polyacrylates obtainable by copolymerization of:

(A) monomers containing amino groups and corresponding to general formula (I)

$$R^1-CH=\overset{\overset{R^2}{|}}{C}-\overset{\overset{O}{\|}}{C}-Z-(C_nH_{2n})-Q, \qquad (I)$$

in which each of $R^1$ and $R^2$ independently represents a hydrogen or a methyl group; Z represents either an oxygen or a —NH— group; n is an integer from 2 to 5; $(C_nH_{2n})$ represents a bivalent aliphatic hydrocarbon moiety that may be straight chain or branched and that contains n carbon atoms; and Q is selected from the group consisting of piperazino, piperidino, and morpholino groups and groups having the formula $$R^3-\overset{|}{N}-R^4,$$

with each of $R^3$ and $R^4$ independently representing a hydrogen or a $C_{1-4}$ alkyl group; and (B) monomeric esters corresponding to general formula (II)

$$R^5-CH=\overset{\overset{R^6}{|}}{C}-\overset{\overset{O}{\|}}{C}-O-R^7, \qquad (II)$$

in which each of $R^5$ and $R^6$ independently represents a hydrogen or a methyl group and R; represents a $C_{1-6}$ alkyl group.

Preferably, the composition as noted above is applied in a separate step before applying a conventional primer or base coat, and/or by adding it to a conventional base coat.

The present invention also may be embodied in use of a composition as noted above as an adhesion promoter for leather finishes in other ways.

An improvement in the adhesion of finishes is obtained in particular with copolymers obtainable by copolymerization of:

(A) dimethylaminoethyl methacrylate, dimethylaminopropyl methacrylamide, 2-tert-butylaminoethyl methacrylate and/or dimethylaminoneopentyl acrylate and (B) alkyl esters, containing 1 to 4 C atoms in the alkyl group, of acrylic acid, methacrylic acid, crotonic acid, and/or 2-methyl crotonic acid.

Copolymers obtainable by copolymerization of dimethylaminoethyl methacrylate and butyl acrylate are particularly preferred.

The copolymerization of the polyacrylates containing amino groups may be carried out by polymerization processes known per se, in aqueous media optionally containing water-miscible solvents, such as alcohols, for example isopropanol. See, e.g., *Ullmanns Encyclopadie der techischen Chemie,* 4th Edition, Vol. 19, pages 3–4, (Verlag Chemie Weinheim 1980). A free radical-forming compound, for example potassium or ammonium peroxysulfate, tert-butyl hydroperoxide, azo-bis-(cyanopentanoic acid), azoisobutyronitrile or 2,2'-azo-bis-(2-amidinopropanedihydrochloride), is added in small quantities as initiator. The monomers are preferably polymerized by simultaneously introducing the monomers containing amino groups and the monomeric esters dropwise into water containing the initiator. The polymerization temperature may vary over a wide range. Temperatures in the range from 60° to 100° C. may be optimal, depending on the initiator used.

The copolymers containing amino groups used according to the invention are soluble in water in their neutralized state or are otherwise present in water-solubilized form. Preferred compositions are those obtainable by copolymerizing 5 to 80% by weight of monomers containing amino groups (component A) and 95 to 20% by weight of monomeric esters (component B). More preferred compositions are obtainable by copolymerizing 30 to 60% by weight of component A and 70 to 40% by weight of component B.

Separate, initial adhesion promoter liquids used according to the invention preferably contain 5 to 50% by weight of the copolymers containing amino groups as characterized above. These copolymers can be used in an adhesion promoter composition either as manufactured or after dilution with water and/or organic solvents such as isopropanol, butanol, glycol ethers, and/or methyl ethyl ketone. Silicone emulsions or solutions; emulsifiers, for example nonionic surfactants, such as ethoxylated fatty alcohols and ethoxylated alkyl phenols, optionally in combination with anionic surfactants, such as alkyl alcohol polyoxyalkyl phosphates and sulfates; and/or wax dispersions may be added to the adhesion promoter liquids. The adhesion promoter liquid may be colored with dye solutions or pigment preparations.

The adhesion promoter liquids may be applied to the leather by spraying, padding, curtain coating, roll-coating, or any other suitable means as known to those skilled in the art. After application of the adhesion promoter liquid, the leather usually is dried, in a manner known to those skilled in the art, preferably by using a forced air drier with an air temperature between 20° and 140° C., more preferably between 60° and 120° C.

To obtain the greatest improvement in the adhesion of leather finishes, it can be advantageous in some cases to apply only part of the total quantity of the copolymers as characterized above to the leather in an initial, separate adhesion promoter liquid and to use the rest in the base coat. In cases such as these, the quantity of copolymers as characterized above in the base coat applied is preferably between 1 and 10 parts by weight and more preferably between 3 and 6 parts by weight, based on 100 parts of binder in the total base coat composition.

The copolymers containing amino groups to be used in accordance with the invention constitute a significantly improved promoter of adhesion to leather by the subsequently applied finishing materials, and they can be used effectively on hydrophobicized leather with no adverse effect on its hydrophobic properties.

The practice of the invention may be further understood with the aid of the following, non-limiting, operating examples.

EXAMPLES

Preparation of Copolymer Solution I 200 g of 2,2'-azo-bis-(2-amidinopropanedihydrochloride) and 55.8 kg of water were introduced into a reactor equipped with a stirrer, two inflow vessels, means for heating and cooling the reactor contents, a reflux condenser, and a thermometer. A mixture of 16.7 kg of dimethylaminoethyl methacrylate, 16.7 kg of butyl acrylate, and 0.7 kg of formic acid (98%) was introduced into one inflow vessel while a solution of 400 g of 2,2'-azo-bis-(2-amidinopropanedihydrochloride) and 4.8 kg of water was introduced into the other inflow vessel. After the initial solution in the reactor had been heated with stirring to 75° C., both inflow solutions were added at the same time over a period of 90 minutes. The internal temperature reached 80° to 82° C. After the addition, the mixture was stirred for 60 minutes at 75° C., cooled to 45° C., and neutralized with 4.7 kg of 50% by weight aqueous formic acid. Neutralization was continued to a stable pH value of 6.5.

An opaque, pale yellowish solution with the following characteristics was obtained:

| | |
|---|---|
| Dry residue: | 33 ± 1% by weight (measured with an IR drying balance at 150° C.); |
| Brookfield viscosity (spindle 2, 20 r.p.m.): | 350–450 mPa.s |
| pH value: | 6.5. |

Practical Use Examples

The adhesion tests in these examples were carried out in accordance with IUF 470.

Example 1 used hide upper leather, hydrophobicized.

Adhesion Promoter Composition and Process

The composition was:

30 parts by weight: Copolymer solution I as described above 50 parts by weight: water 50 parts by weight: a solution of acidic phosphoric acid esters (Kepeco® Fluid L from Henkel KGaA).

This composition was sprayed on the leather in an amount sufficient to wet it thoroughly. The leather was then dried with a conventional forced air dryer by methods known to those skilled in the art, with air between 60° and 120° C.

Base Coat Composition and Process

The composition was:

100 parts by weight pigment 150 parts by weight polyacrylate dispersion 100 parts by weight polyurethane dispersion 10 parts by weight silica-based matte finish additive 25 parts by weight wax-based release agent.

This composition was padded onto the leather, which had already on it the dried adhesion promoting composition as noted above, one time, and then the same composition was sprayed on the leather one time. The leather thus treated was pressed against a smooth, polished plate at 80° C. and 50 bars pressure.

Top Coat Composition and Process

The composition was:

100 parts by weight nitrocellulose emulsion 100 parts by weight water.

This composition was sprayed twice onto the leather treated as above, and the sprayed leather was smoothed by pressing against a polished plate at 100° C.

Comparative Example 1C

This was performed in the same manner as Example 1, but without any adhesion promoter coating.

IUF 470 Adhesion Test Results

Example 1: 3.6 N/cm

Example 1C: 1.2 N/cm

Example 2 used hide motorcycle leather, hydrophobicized.

Adhesion Promoter Composition and Process

The composition was:

40 parts by weight Copolymer solution I as described above 100 parts by weight methyl ethyl ketone 30 parts by weight n-hexyl glycol ether 30 parts by weight isopropanol 30 parts by weight water This oomposition was roll coated onto the leather surface one time.

Base Coat Composition and Process

The composition was:

50 parts by weight pigment
100 parts by weight polyacrylate dispersion
100 parts by weight polyurethane dispersion
50 parts by weight butadiene copolymer dispersion
400 parts by weight water
30 parts by weight silica-based matte finish additive
20 parts by weight wax emulsion
10 parts by weight Fluid UP TM (Henkel KGaA)

This composition was sprayed onto the leather three times, and the leather was then pressed against a smooth, polished plate at 80° C. and 50 bars pressure.

Top Coat Composition and Process

The composition was:

100 parts by weight nitrocellulose emulsion
20 parts by weight polyacrylate dispersion
20 parts by weight silica-based matte finish additive
10 parts by weight Fixativ FF TM (Henkel KGaA)
100 parts by weight water.

This composition was sprayed on the leather twice, and the leather was then smoothed by pressing against a polished plate at 100° C., tumble-dried, and stretched.

Comparison Example 2C

This was performed in the same manner as Example 2, but with no adhesion promoter used.

IUF 470 Adhesion Test

Example 2: 4.2 N/cm
Example 2C: 1.1 N/cm

What is claimed is:

1. In a process for finishing leather, the improvement comprising applying to the surface of the leather, after tanning and oiling but before applying the bulk of the materials to be used in finishing, a composition obtainable by copolymerization of only:

(A) monomers containing amino groups and corresponding to general formula (I)

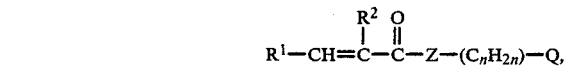

$$R^1-CH=\overset{\overset{R^2}{|}}{C}-\overset{\overset{O}{\|}}{C}-Z-(C_nH_{2n})-Q, \quad (I)$$

in which each of $R^1$ and $R^2$ independently represents a hydrogen or a methyl group; Z represents either an oxygen or a —NH— group; n is an integer from 2 to 5; $(C_nH_{2n})$ represents a bivalent saturated hydrocarbon moiety that may be straight chain or branched and that contains n carbon atoms; and Q is selected from the group consisting of piperazino, piperidino, and morpholino groups and groups having the formula $R^3$—N—$R^4$, with each of $R^3$ and $R^4$ independently representing a hydrogen or a $C_{1-4}$ alkyl group; and (B) monomeric esters corresponding to general formula (II)

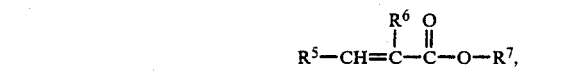

$$R^5-CH=\overset{\overset{R^6}{|}}{C}-\overset{\overset{O}{\|}}{C}-O-R^7, \quad (II)$$

in which each of $R^5$ and $R^6$ independently represents a hydrogen or a methyl group and $R^7$ represents a $C_{1-6}$ alkyl group.

2. A process according to claim 1, wherein said composition is obtainable by copolymerizing from about 5 to about 80% by weight of monomers of type (A) and from about 95 to about 20% by weight of monomers of type (B).

3. A process according to claim 2, wherein said composition is obtainable by copolymerizing from about 30 to about 60% by weight of monomers of type (A) and from about 70 to about 40% by weight of monomers of type (B).

4. A process according to claim 3, wherein said composition is obtainable by copolymerizing monomers of type (A) selected from the group consisting of dimethylaminoethyl methacrylate, dimethylaminopropyl methacrylamide, 2-tert-butylaminoethyl methacrylate, and dimethylaminoneopentyl acrylate.

5. A process according to claim 2, wherein said composition is obtainable by copolymerizing monomers of type (A) selected from the group consisting of dimethylaminoethyl methacrylate, dimethylaminopropyl methacrylamide, 2-tert-butylaminoethyl methacrylate, and dimethylaminoneopentyl acrylate.

6. A process according to claim 5, wherein said composition is obtainable by copolymerizing monomers of type (B) selected from the group consisting of esters of acrylic acid, methacrylic acid, crotonic acid, and 2-methyl crotonic acid with monomeric alcohols containing 1 to about 4 carbon atoms.

7. A process according to claim 4, wherein said composition is obtainable by copolymerizing monomers of type (B) selected from the group consisting of esters of acrylic acid, methacrylic acid, crotonic acid, and 2-methyl crotonic acid with monomeric alcohols containing 1 to about 4 carbon atoms.

8. A process according to claim 3, wherein said composition is obtainable by copolymerizing monomers of type (B) selected from the group consisting of esters of acrylic acid, methacrylic acid, crotonic acid, and 2-methyl crotonic acid with monomeric alcohols containing 1 to about 4 carbon atoms.

9. A process according to claim 2, wherein said composition is obtainable by copolymerizing monomers of type (B) selected from the group consisting of esters of acrylic acid, methacrylic acid, crotonic acid, and 2-methyl crotonic acid with monomeric alcohols containing 1 to about 4 carbon atoms.

10. A process according to claim 9, wherein said composition is applied to the leather in the form of a separate adhesion promoter fluid containing from about 5 to about 50% by weight of the composition.

11. A process according to claim 8, wherein said composition is applied to the leather in the form a separate adhesion promoter fluid containing from about 5 to about 50% by weight of the composition.

12. A process according to claim 7, wherein said composition is applied to the leather in the form of a separate adhesion promoter fluid containing from about 5 to about 50% by weight of the composition.

13. A process according to claim 6, wherein said composition is applied to the leather in the form of a separate adhesion promoter fluid containing from about 5 to about 50% by weight of the composition.

14. A process according to claim 5, wherein said composition is applied to the leather in the form of a separate adhesion promoter fluid containing from about 5 to about 50% by weight of the composition.

15. A process according to claim 4, wherein said composition is applied to the leather in the form of a separate adhesion promoter fluid containing from about 5 to about 50% by weight of the composition.

16. A process according to claim 3, wherein said composition is applied to the leather in the form of a separate adhesion promoter fluid containing from about 5 to about 50% by weight of the composition.

17. A process according to claim 2, wherein said composition is applied to the leather in the form of a separate adhesion promoter fluid containing from about 5 to about 50% by weight of the composition.

18. A process according to claim 12, wherein said composition consists essentially of a copolymer of dimethylaminoethyl methacrylate and butyl acrylate.

19. A process according to claim 7, wherein said composition consists essentially of a copolymer of dimethylaminoethyl methacrylate and butyl acrylate.

20. A process according to claim 1, wherein said composition consists essentially of a copolymer of dimethylaminoethyl methacrylate and butyl acrylate.

* * * * *